United States Patent [19]

Fitting

[11] 4,202,529

[45] May 13, 1980

[54] SMALL VEHICLE LIFT

[75] Inventor: William L. Fitting, 167 Humboldt, Brisbane, Calif. 94005

[73] Assignees: William L. Fitting, Brisbane; David A. Bostrom, Daly City, both of Calif.

[21] Appl. No.: 874,142

[22] Filed: Feb. 1, 1978

[51] Int. Cl.[2] ..... B66F 7/12

[52] U.S. Cl. ..... 254/89 H

[58] Field of Search ..... 254/89 H, 89 R, 45, 254/47, 139.1, 144; 214/392, 394, 396

[56] References Cited

U.S. PATENT DOCUMENTS

| | | | |
|---|---|---|---|
| 141,669 | 8/1873 | Rood | 254/47 |
| 1,204,470 | 11/1916 | Miller | 254/144 |
| 3,494,492 | 2/1970 | Thiermann | 254/139.1 |
| 3,759,409 | 9/1973 | Wenzel et al. | 214/394 |

*Primary Examiner*—Robert C. Watson

*Attorney, Agent, or Firm*—Owen, Wickersham & Erickson

[57] ABSTRACT

A small vehicle lift particularly adapted for motorcycles is disclosed. It includes a superstructure with depending connectors at front and rear for suspending the vehicle, and the entire superstructure is raised and lowered by means of a pair of fluid actuated cylinders included in a pair of floor-mounted upright supports connected to the superstructure and spaced apart on either side of the vehicle. Means are provided for locking the superstructure in the raised position.

5 Claims, 4 Drawing Figures

SMALL VEHICLE LIFT

BACKGROUND OF THE INVENTION

The invention relates to vehicle lifting apparatus, and more particularly to a small vehicle lift which raises the vehicle by means of members suspended from above.

A wide variety of types of vehicle lifts have been suggested or used previously. Some have been particularly adapted for motorcycles, such as that shown in British Pat. No. 262,972, involving four legs and a chain hoist.

U.S. Pat. Nos. 2,593,635, 2,958,508 and 2,968,260 show other types of vehicle lifting apparatus. The former patent discloses an automobile lift having only two floor-mounted supports, utilizing a chain hoist and bottom-supporting lift brackets, with no superstructure. The latter two patents disclose vehicle lifting apparatus involving fluid actuated lifting means.

There has been a need for an efficient lift for small vehicles, particularly motorcycles, wherein ample room is left for working at the bottom and sides of the vehicle, without obstruction of the tires, engine etc. Further, there has been a need for such an apparatus which can be quickly and efficiently actuated to raise the vehicle, and which is not overly complex or expensive to produce.

SUMMARY OF THE INVENTION

The present invention provides a small vehicle lift which overcomes the shortcomings of prior apparatus useable for raising small vehicles. The lift of the invention is relatively simple in construction, is easily attached to the vehicle, and raises the vehicle quickly and smoothly.

A lift according to the invention, particularly useful for motorcycles, is mounted on the floor at only two points, spaced from the sides of the vehicle. At these locations a pair of upright supports extend vertically to an overhead frame, which preferably includes a cross member extending between the tops of the uprights and cantilevered frame portions extending to front and rear, at generally right angles to the cross member. At the front and rear of the overhead frame are end members from which are suspended a pair of hanger members which are readily attached to the vehicle by means of flexible straps, while the vehicle rests on the floor.

The overhead frame preferably includes truss members, so that lighter members may be used for the cross member and the forward and rearward extending portions.

To raise the vehicle, pneumatic or hydraulic fluid pressure is applied to the lower sections of the upright supports, which comprise fluid cylinders. Upper sections telescope out of the lower sections, being attached to piston rams within the cylinders. Means are provided for locking the apparatus in the raised position, and for releasing fluid pressure to lower the vehicle.

The apparatus of the invention affords a great deal of work room around the raised vehicle, being supported on only two floor-mounted supports which are spaced apart sufficiently not to interfere. Thus, an operator or mechanic can very quickly connect a vehicle to the supporting straps, apply fluid pressure to the cylinders to raise the vehicle, lock the lift in the raised position, and begin performing work on the vehicle without hindrance by posts or by under-the-tire type platform supports.

Accordingly, it is among the objects of the invention to provide a small vehicle lift which is relatively simple in construction, very efficient in operation, and which affords ample unhindered space for working on the vehicle. These and other objects, advantages and features of the invention will be apparent from the following description of a preferred embodiment, taken in conjunction with the accompanying drawings.

DESCRIPTION OF THE PREFERRED EMBODIMENT

Figures 1, 2:
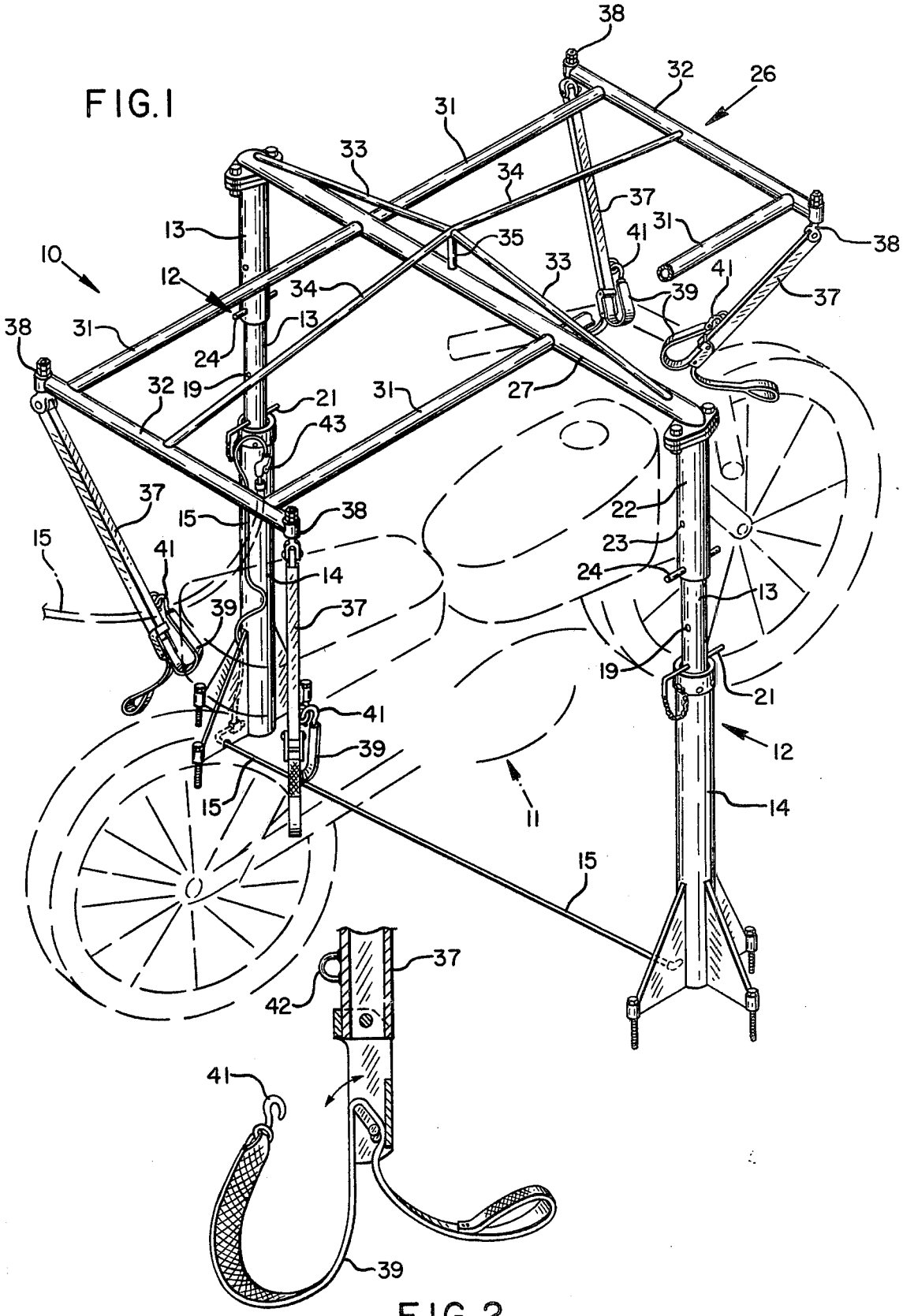
FIG. 1 is a perspective view of a small vehicle lift according to the invention, showing a motorcycle in phantom, raised to a working position by the apparatus.
FIG. 2 is an enlarged, partially sectioned detail view showing a strap of the lift apparatus, for attachment to the vehicle.

In the drawings, FIG. 1 shows a small vehicle lift 10 suspending from above a motorcycle 11, shown in phantom. The lift apparatus includes a pair of upright supports 12, each of which comprises an upper portion 13 and a lower portion 14. As indicated, the upper portion is extendable from the lower portion, preferably by telescoping out therefrom. Thus, the uprights 12 each comprise fluid cylinder and ram units, with the upper portion 13 being a piston ram reciprocable within the lower portion 14, which is or contains a fluid cylinder.

Figure 4:
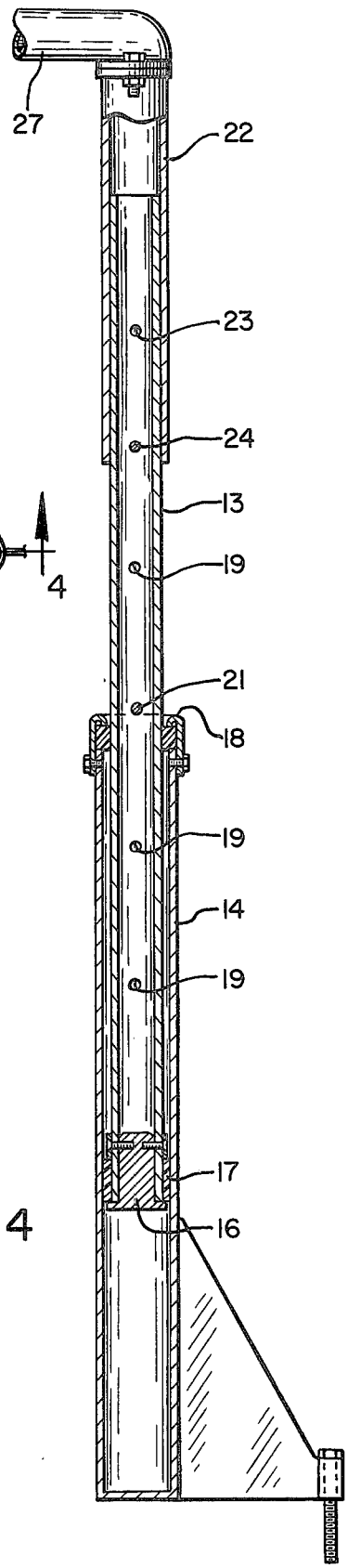
FIG. 4 is an enlarged sectional view of an upright support of the lift apparatus, taken along the line 4—4 of FIG. 3.

FIG. 4 shows a preferred structure of the fluid cylinder and ram upright support 12. Fluid, preferably compressed air, is admitted to the bottom of the lower portion 14 through lines 15 (FIG. 1), where its pressure acts against the bottom of an end fitting 16 which is engaged by a slidable seal 17 with the inside surface of the cylinder 14. At the top of the lower upright portion or cylinder 14 is a slide bearing 18. A series of bores 19 through the ram or upper portion 13 provide a series of locking levels for insertion of a locking pin 21, as shown in FIGS. 1 and 4. The two pins 21 are inserted in the appropriate bores when the vehicle 11 has risen to the desired level.

FIGS. 1 and 4 also illustrate that the upper upright portion 13 may have a top extension 22 of adjustable height. Two or more openings 23 may be provided in the extension 22 and in the piston ram member inside, to receive an adjustment pin 24, the position of which establishes the maximum and minimum heights of the lift apparatus 10. This construction also enables the easy dismantling and assembly of the lift apparatus.

Figure 3:
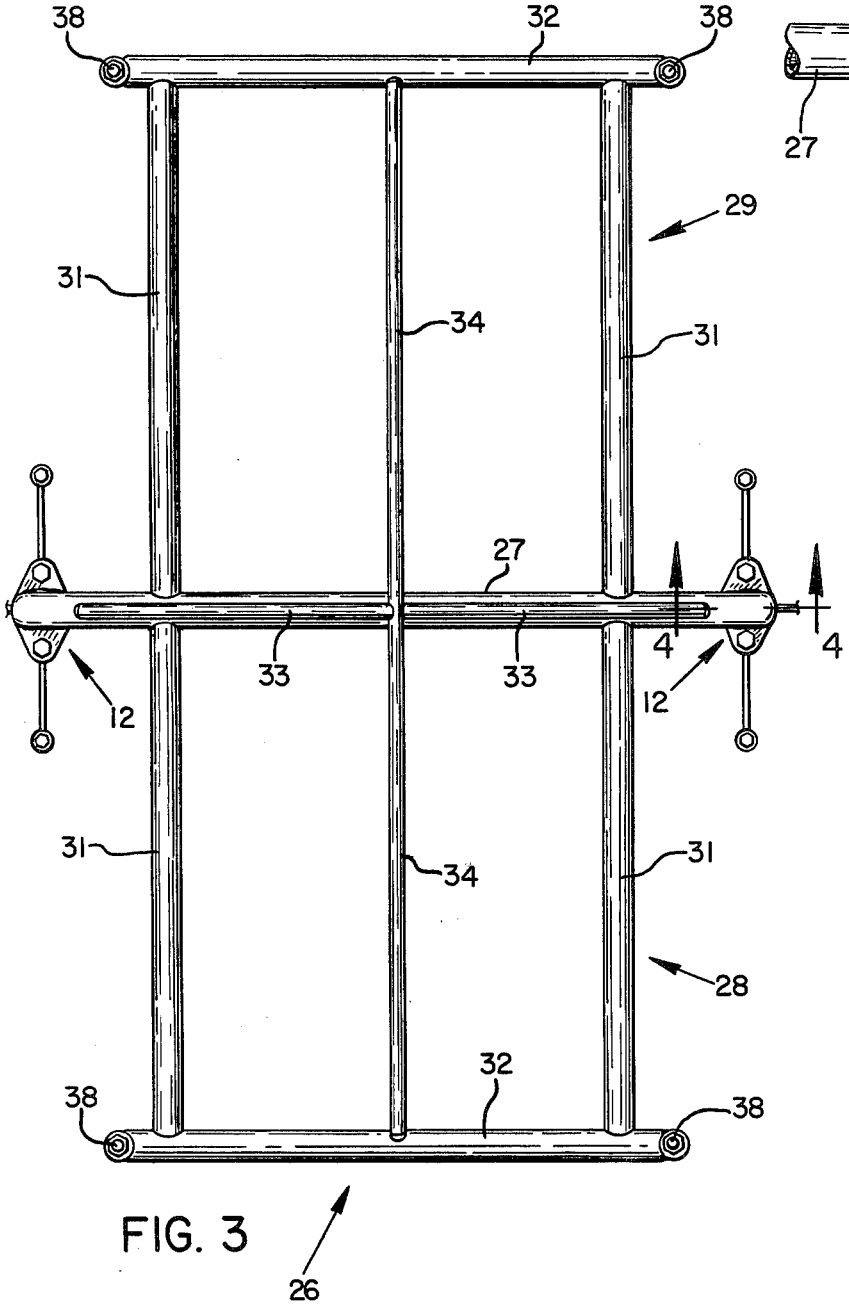
FIG. 3 is a plan view of the lift.

The vehicle 11 is connected to an overhead frame assembly 26 for lifting. As shown in FIGS. 1 and 3, the frame assembly 26 preferably includes a cross member 27 connected to the tops of the upright supports 12. To this member are connected forward and rearward frame portions 28 and 29, either of which may actually be oriented toward the front of the vehicle. Each of these frame portions may include longitudinal members 31 as shown, with end members 32 affixed to the ends of the longitudinal members as shown. For extra load-supporting strength, and so that lighter members 27 and 31 can be used, the cross member 27 and the longitudinal members 31 may be trussed as shown by bracing members 33, 34 and 35. Thus, the cross member 27 and bracing members 33 and 35 are one truss spanning the distance between the uprights 12, with the bracing members 33 in compression, while the members 31, 32, 34, 35 and 27 form a sort of truss in the perpendicular direction, with the bracing members 34 in tension. The bracing members 34 aid the longitudinal members 31 by transmitting load-supporting strength to the end members 32. This part of the load is of course transmitted to the center of the cross member 27 by the vertical brace member 35.

Each end member 32 suspends connecting means for lifting the vehicle 11 from above, preferably including a pair of rigid bars 37. For versatility of movement and connection to various sizes and shapes of vehicles, the bars are preferably connected to the ends of the end members 32 by swivel and pivot type joints 38. The lower end of each rigid bar 37 has connected to it a flexible strap 39 for attachment to the vehicle. The strap 39 may be adjustable in length extending from the bar, as shown in FIG. 1 and particularly in the sectional view of FIG. 2. Each strap is preferably inserted underneath and around some component of the vehicle so as not to obstruct the maintenance to be performed. On a motorcycle, this may be the handlebars and perhaps some structural members at the rear. A hook 41 at the end of the strap may be secured in an eyelet 42 on the bar 37, forming a closed loop for support of the vehicle.

When the vehicle is to be lowered, the pins 21 are removed and fluid is released by manual actuation of a valve, which may be included in the inlet fluid line 15, as indicated at 43. The fluid is preferably compressed air, for several reasons: it is usually available in a vehicle maintenance shop; it is generally faster-acting than hydraulic fluid in a cylinder; and when the pressure is released, the air may by simply discharged to the atmosphere.

If on lifting the vehicle, air pressure to the cylinders 14 is not continued after the pins 21 are inserted, the weight of the vehicle 11 and frame 26 will usually settle onto the pins 21, since air may slowly bleed out of the cylinders 14. Thus, when the vehicle is to be lowered, pressure should first be applied to raise the piston ram 13 slightly for removal of the pin.

The above described preferred embodiment provides a small vehicle lift, particularly suitable for motorcycles, which avoids complexity of structure, which is very quickly and efficiently operated, and which affords ample workroom for a vehicle without obstruction. Various other embodiments and changes to this preferred embodiment will be apparent to those skilled in the art and may be made without departing from the spirit and scope of the following claims.

I claim:

1. A small vehicle lift, comprising:

a pair of upright supports, spaced apart to accommodate a small vehicle therebetween, each upright support including an upper portion comprising a piston ram and a lower portion including a fluid actuated cylinder, said upper portion being telescopically received and reciprocable in the lower portion, said upper portions being adapted to be extended upwardly from the lower portions in response to the introduction of fluid pressure into the fluid actuated cylinders;

means for mounting the lower upright support portions on a floor;

frame means connected to both upper support portions, including forward and rearward portions and a cross member directly connecting the tops of the upper support portions, said forward and rearward portions extending forward and rearward generally perpendicularly to the cross member;

means depending from the forward and rearward portions for connecting to and suspending the vehicle from its front and rear; and means associated with the telescoping connection between the upper and lower support portions for locking the upper support portions in the upward extended position.

2. The small vehicle lift of claim 1 wherein the upright supports are spaced apart sufficiently to accommodate a motorcycle between them, and wherein the connecting and suspending means each include left and right portions and are spaced apart the appropriate distances so that the front connecting and suspending means is positioned to attach to the motorcycle handlebars from right and left, and the rear connecting and suspending means is positioned to attach to the motorcycle at the rear of the seat, suspending it from left and right.

3. The small vehicle lift of claim 1 wherein the frame means includes brace means connected to the cross member and forming, in a vertical plane, a rigid transverse truss for increasing the load-supporting strength of the cross member.

4. A small vehicle lift, comprising:

a pair of upright supports, spaced apart to accommodate a small vehicle therebetween, each upright support including an upper portion and a lower portion;

means for mounting the lower upright support portions on a floor;

fluid actuated cylinder means associated with the upper and lower support portions for extending the upper portions upward from the lower portions;

frame means connected to both upper support portions, including forward and rearward portions, longitudinal frame members and end members connected perpendicularly to the ends of the longitudinal frame members;

means depending from the forward and rearward portions, near the ends of the end members, for connecting to and suspending the vehicle from its front and rear, said depending means comprising, at each end member, a pair of rigid bars, one pivotally connected to each end of the end member, and fliexible strap means for connection to the vehicle; and means for locking the upper support portions in the upward extended position.

5. The small vehicle lift of claim 4 wherein each rigid bar is pivotally connected to the end member by pivot means including both vertical and horizontal pivot axes, so that the bar is maneuverable in many directions.

* * * * *